US005147225A

United States Patent [19]

Kile et al.

[11] Patent Number: 5,147,225

[45] Date of Patent: * Sep. 15, 1992

[54] SHROUD-TO-BOARD POLARIZATION AND KEYING SYSTEM

[75] Inventors: Richard A. Kile, Hummelstown; Ronald P. Locati, Harrisburg; Joseph R. Smee, Oberlin-Steelton; Charles T. Wood, Palmyra, all of Pa.

[73] Assignee: AMP Incorporated, Harrisburg, Pa.

[ * ] Notice: The portion of the term of this patent subsequent to Aug. 6, 2008 has been disclaimed.

[21] Appl. No.: 645,864

[22] Filed: Jan. 25, 1991

[51] Int. Cl.[5] ..... H01R 13/64

[52] U.S. Cl. ..... 439/680; 439/374; 439/564

[58] Field of Search ..... 439/60-62, 439/64-66, 76, 79, 569-572, 629-637, 680, 681

[56] References Cited

U.S. PATENT DOCUMENTS

| | | | |
|---|---|---|---|
| 3,264,599 | 8/1966 | Kinkaid | 339/17 |
| 3,325,771 | 6/1967 | Ruehlemann et al. | 439/681 |
| 3,601,770 | 8/1971 | Bowley | 439/629 |
| 3,685,001 | 8/1972 | Krafthefer | 339/17 L |
| 3,768,066 | 10/1973 | Mattingly, Jr. et al. | 339/65 |
| 3,966,290 | 6/1976 | Little et al. | 339/17 LC |
| 4,193,108 | 3/1980 | Romano | 439/79 |
| 4,204,737 | 5/1980 | Faber et al. | 339/65 |
| 4,350,409 | 9/1982 | Kato et al. | 339/186 M |
| 4,507,861 | 4/1985 | Sprenkle | 29/741 |
| 4,530,561 | 7/1985 | Tyree et al. | 439/570 |
| 4,586,254 | 5/1986 | Ammon et al. | 439/636 |
| 4,603,929 | 8/1986 | Fitzpatrick | 339/17 C |
| 4,664,462 | 5/1987 | Owens | 439/564 |
| 4,744,140 | 5/1988 | Bright | 29/741 |
| 4,929,183 | 5/1990 | Rinneburger | 439/67 |
| 5,035,641 | 7/1991 | Van-Santbrink et al. | 439/567 |
| 5,037,323 | 8/1991 | Locati | 439/374 |

FOREIGN PATENT DOCUMENTS

| | | | |
|---|---|---|---|
| 0210686 | 2/1987 | European Pat. Off. | 439/570 |
| 6503360 | 9/1965 | Netherlands | 439/570 |

OTHER PUBLICATIONS

IBM Technical Disclosure Bulletin, vol. 33, No. 1A, Jun. 1990.

*Primary Examiner*—Larry I. Schwartz
*Assistant Examiner*—Hien D. Vu
*Attorney, Agent, or Firm*—David L. Smith

[57] ABSTRACT

An alignment and blind mate assist shroud (22) having a body section securable to a connector housing (24) has a protrusion (150) adapted to extend beyond the mounting face (48,50) of the connector housing (24) to key the connector assembly (62) to a particular one of several possible assembly receiving locations on the circuit board (154) on which the assembly (62) is mounted. The polarization protrusion (150) cooperates with an aperture (152) in the circuit board (154) on which the connector assembly (62) is adapted to be mounted to assure that the appropriate connector assembly (62) is mounted at the corresponding location on the circuit board. The polarization protrusion may be provided at any one of several locations to also provide a connector assembly to board keying function.

12 Claims, 2 Drawing Sheets

SHROUD-TO-BOARD POLARIZATION AND KEYING SYSTEM

BACKGROUND OF THE INVENTION

This invention relates to electrical connectors and, in particular, to a shroud for securing to an electrical connector to key the connector to one of several locations on a printed circuit board. The shroud has a protrusion receivable in an aperture in the circuit board on which the connector is mounted to assure that the appropriate connector is positioned at the corresponding appropriate one of several possible locations for such connectors on the circuit board.

Alignment and blind mate assist shrouds securable to a connector to form a connector assembly mountable to a circuit board are known. One application has required that several such connector assemblies be mounted to a single circuit board. In an effort to assist those persons who assemble the mating or complementary connectors to the various connector assemblies on a single board to correlate a particular mating connector to the intended one of the several possible connector assemblies, the pair of shrouds secured to each connector on the board have been made of various colors of plastic such as yellow, red, white, gray, green, or blue. That is, each connector had secured to it two shrouds of a single particular color so as to color code each connector assembly by the color of the shrouds. While this approach was successful to help those who assembled the mating connectors to the various connector assemblies by permitting the mating connector assembler to select the proper one of the assemblies to mate a particular mating connector to by color, it was successful only if the connector assembly having the appropriate color shrouds was positioned at the corresponding location on the circuit board during stuffing of the components thereon. Since each of the shrouds was identical to the other shrouds, but for color, there was always the possibility that an error could be made in positioning a connector assembly having shrouds of the wrong color at a particular assembly receiving position on a circuit board. This could then lead to the wrong mating connector being mated thereto.

There is disclosed in U.S. Pat. No. 4,507,861 a tool for grasping then stuffing rectangular electronic components on a circuit board. The tool has foot-like extensions for grasping the electronic component at each of the corners. Three of the four foot-like extensions have locator pins receivable in apertures in the printed circuit board to provide a polarization feature to assure that the tool stuffs the component on the circuit board with a particular orientation.

U.S. Pat. No. 4,744,140 discloses a tool for mounting connectors onto a circuit board. The tool includes a pair of pins, one of smaller diameter and one of larger diameter, which pass through holes in the connector to be mounted then into corresponding apertures in the printed circuit board. The tool provides for the connector to be received on the pins in only one orientation and, since the board is provided with holes identically sized to the pins and precisely located, the connector is positioned on the board by the tool in a predetermined orientation that accurately pilots the connector leads into plated through holes in the circuit board.

SUMMARY OF THE INVENTION

In accordance with the present invention, an alignment and blind mate assist shroud having a body section securable to a connector housing has a keying protrusion adapted to extend beyond the mounting face of the connector housing to key the connector assembly. The keying protrusion cooperates with an aperture in the printed circuit board on which the pin header assembly is adapted to be mounted to assure that the appropriate connector assembly is mounted at the corresponding location on the printed circuit board.

DESCRIPTION OF THE PREFERRED EMBODIMENT

Figure 1:
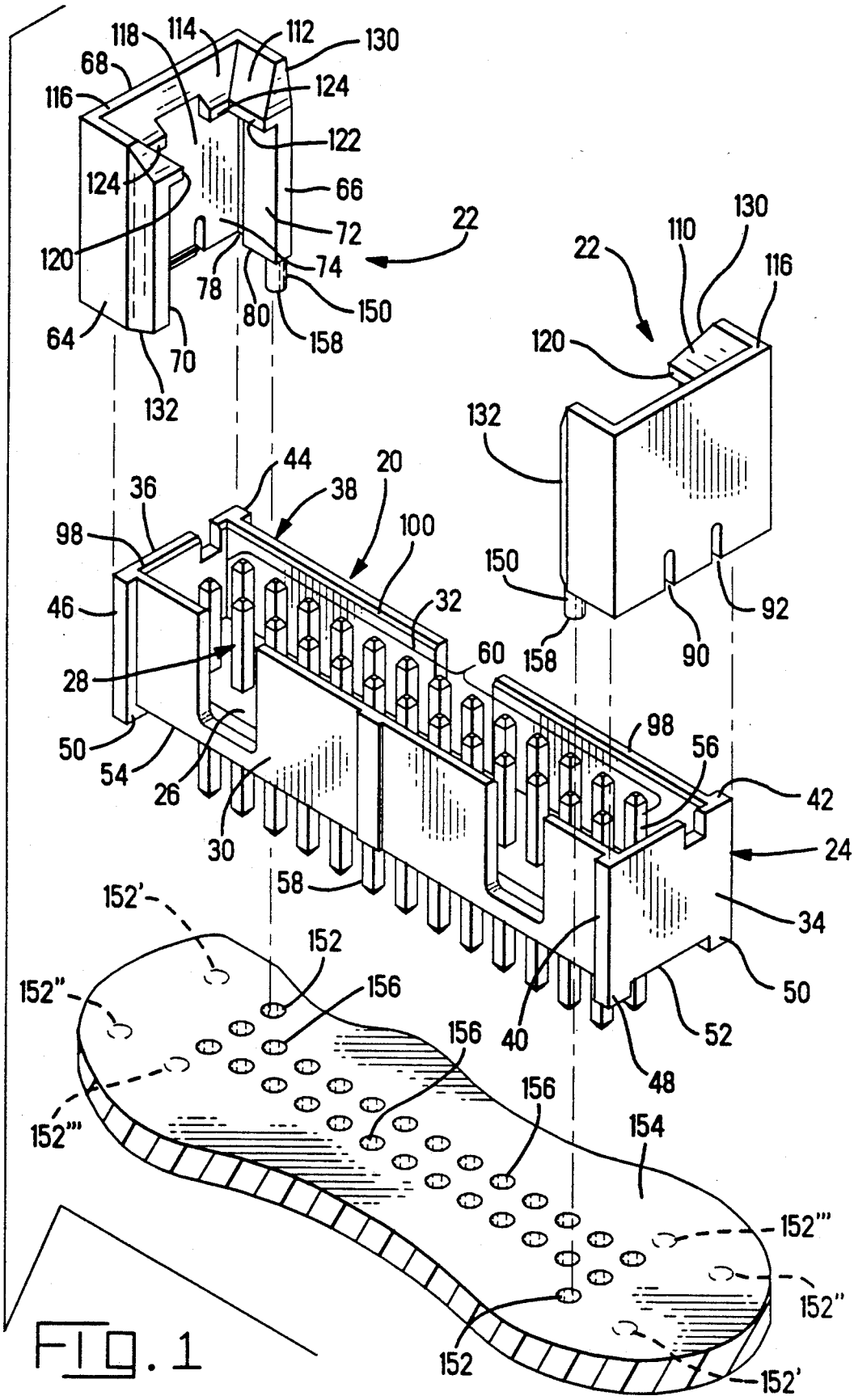
FIG. 1 is a perspective view of a pin header having two alignment and blind mate assist shrouds in accordance with the present invention, exploded therefrom and exploded from a portion of a printed circuit board.

FIG. 1 illustrates a pin header 20 having two alignment and blind mate assist shrouds 22 in accordance with the present invention positioned thereabove exploded from a portion of a circuit board 154 having a pair of protrusion receiving apertures 152 positioned for reception of protrusions 150 as header 20 is mounted on board 154 and solder tail portions 58 are received in plated through holes 156. Pin headers 20 include a housing 24 molded of a suitable plastic having base 26 through which pins 28 extend. Housing 24 is elongate and includes sidewalls 30 and 32 integral with and extending transverse to base 26, and end walls 34 and 36 also integral with and extending transverse to base 26. Walls 30, 32, 34 and 36 surround pins 28 to define shroud 38. Endwalls 34 and 36 extend outwardly beyond sidewalls 30 and 32 to form substantially identical ribs 40, 42, 44 and 46. Endwalls 34 and 36 extend downward from base 26 to form standoffs 48 and 50 with recesses 52, substantially coplanar with bottom surface 54 of base 26, therebetween. Pins 28 may be any known structure and are typically spaced on 0.100 inch (2.54 mm) center lines both between adjacent pins in a row and between rows of pins. Pins 28 have a mating portion 56 extending upwardly from base 26 substantially the height of shroud 38 and a solder tail portion 58 extending below base 26 for reception in plated through holes in circuit board (154). Pins 28 are secured in base 28 and form an array 60. A typical pin header is part no. 103308-6 sold by the assignee.

Figure 3:
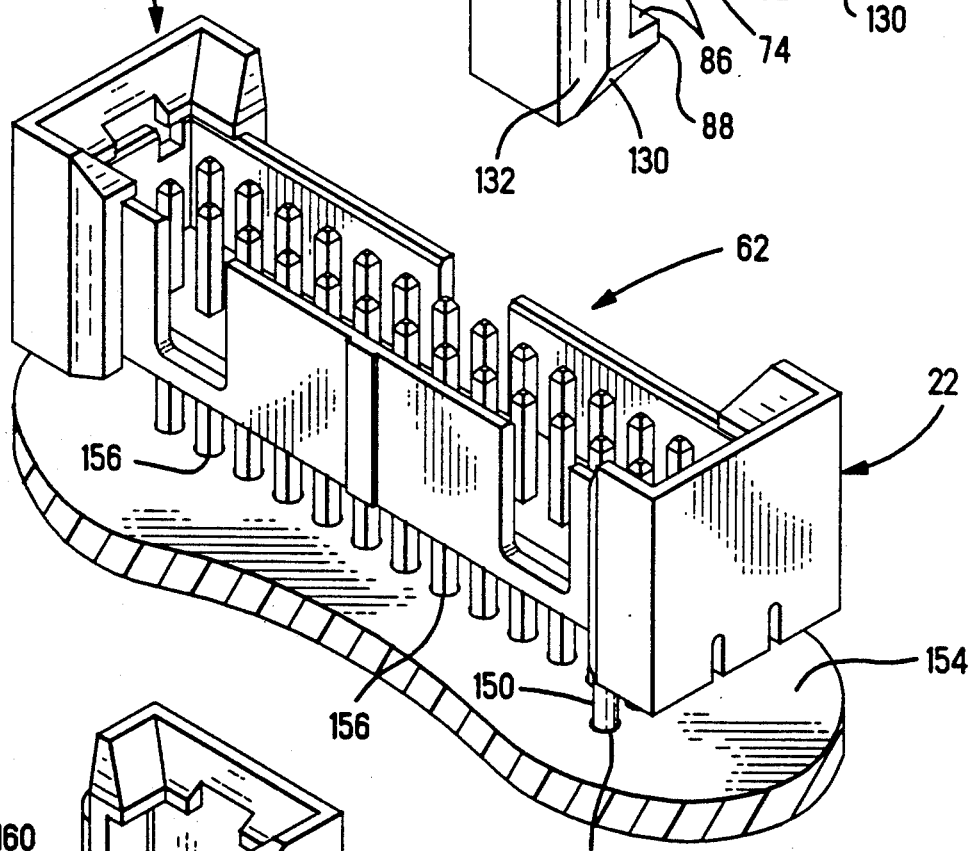
FIG. 3 is a perspective view of a pin header assembly in accordance with the present invention including two alignment and blind mate assist shrouds being mounted to the portion of the printed circuit board shown in FIG. 1.

Alignment and blind mate assist shrouds 22 shown exploded from endwalls 34 and 36 in FIG. 1, as well as secured to pin header 20 in FIG. 3 forming assembly 62, are identical and therefor only one need be described. Shrouds 22 are molded of a suitable plastic.

Figure 2:
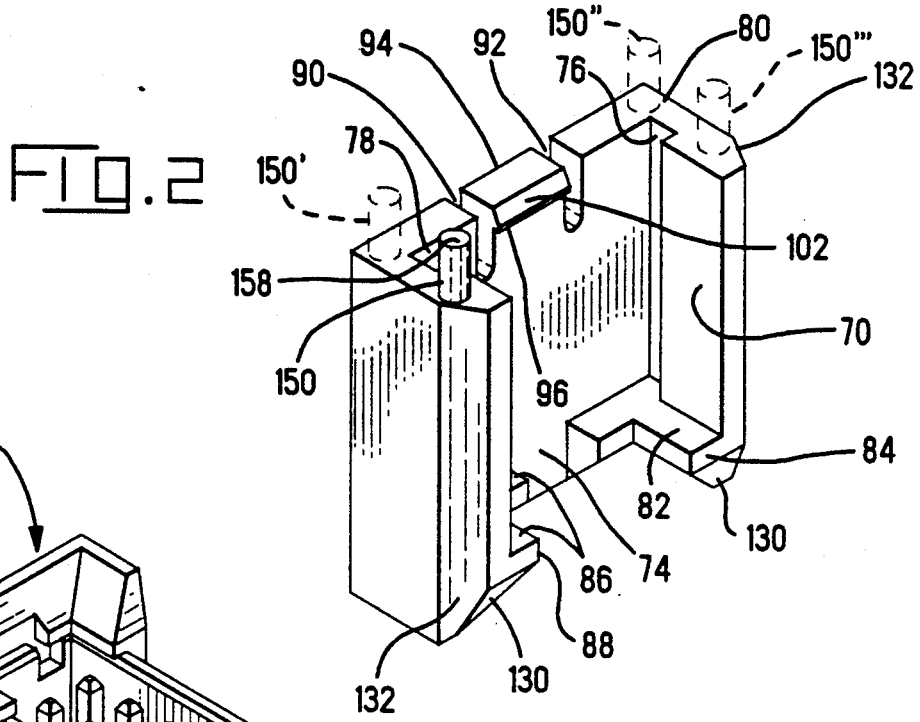
FIG. 2 is a bottom perspective view of an alignment and blind mate assist shroud having a polarization protrusion, and showing in phantom other possible locations of polarization protrusions.

As best seen in FIGS. 1, 2 and 3, shroud 22 is substantially U-shaped in cross section having side members 64 and 66 interconnected by end member 68. Each shroud 22 consists of a body portion securable to pin header 20 and an extension portion adapted to extend above shroud 38 to assist in aligning a complementary connector during mating or unmating thereof and a protrusion 150 extending therefrom. Inner surfaces 70 and 72 of side members 64 and 66 respectively are spaced substantially as the outer surface of sidewalls 30 and 32. Extending into side members 64 and 66 beyond surfaces 70 and 72 adjacent to inner surface 74 of end member 68 are channels 76 and 78. Channel 76 is complementary to ribs 46 or 42 and extends from bottom surface 80 to the lower surface 82 of offset 84 (see FIG. 2). Similarly channel 78 is complementary to ribs 40 or 44 and extends from bottom surface 80 to the lower surface 86 of offset 88. Shroud 22 has a protrusion 150 extending beyond bottom surface 80 from a predetermined location thereon to extend beyond a bottom surface of shroud 22 when secured thereto. In the preferred embodiment, protrusion 150 is cylindrical in cross section so as to be received in an aperture drilled in the circuit board on which shroud 22 is mounted.

End member 68 has a pair of spaced slots 90, 92 extending upwardly from bottom surface 80 defining therebetween latch 94. Latch 94 assures that shroud 22 is retained on header 20. Latch 94 provides a latch shoulder 96 extending inwardly from inner surface 74 and spaced from lower surfaces 82 and 86 substantially the distance from top surface 98 of shroud 38 to recess 52, which is typically the bottom surface 54 of base 26. Top surface 98 may be beveled at the inner edge 100. Ramp surface 102 extends from bottom surface 80 angularly upwardly toward latch shoulder 96 to facilitate positioning.

Protrusions 150 extend from shroud 22 of assembly 62 at a location to be received in aperture 152 of circuit board 154 when solder tail portions 58 are received in plated through holes 156. Protrusions 150 extend to respective distal ends 158 sufficiently beyond the end of stand-offs 48,50 to prevent stand-offs 48,50 from engaging printed circuit board 154 if an assembly is positioned at an assembly receiving location on circuit board 154 not intended for that particular assembly 62.

FIG. 2 shows a protrusion 150 at a particular location on bottom surface 80 and three additional possible locations, shown in phantom as protrusions 150', 150'', and 150'''. In the preferred embodiment only one protrusion is employed on each shroud, however, the invention is not limited thereto. Each protrusion location 150', 150'' and 150''' on shroud 22 has a corresponding aperture location on board 154 such that the protrusion is received in respective apertures 152', 152'', and 152'''. Four possible protrusion locations are thus defined on bottom surface 80 and four corresponding unique shrouds are defined with only a single protrusion 150, 150', 150'' or 150''' being employed on each shroud 22 in the preferred embodiment.

In this manner, shrouds of a particular color can be manufactured with a protrusion at a particular one of the possible locations to overcome the aforementioned problem and to assure that each assembly is mounted at the corresponding one of several possible assembly receiving locations. When a pair of shrouds 22 of the same color, hence having protrusions at the same locations, are received on a header 20 the protrusions 150, 150', 150'' or 150''' are spaced symmetrically about housing 24. Assembly 62 could be received on board 154 in either one of two orientations. A housing-to-board polarization feature may be employed to polarize the orientation of housing 24, and hence assembly 62, relative to board 154.

In this manner, the pair of protrusions on shrouds 22 of assembly 62 provide a keying function that permits an assembly 62 to be mounted to circuit board 154 and be seated thereagainst when the respective protrusions align with and be received in the respective apertures in the board on which the assembly is to be mounted. As solder tails 58 are received in plated through holes 156, the pair of protrusions prevent an assembly 62 from mounting to and seating against board 154 when the protrusions do not align with apertures in board 154. When the protrusions are properly keyed to the location that receives an assembly, in addition to the solder tails being received in plated through holes 156, protrusions 150 are received in spaced apertures 152 as shown in FIG. 3. When the protrusions are located as shown by phantom protrusions 150', the board apertures to receive them are spaced as shown by phantom apertures 152'. When the protrusions are located as shown by phantom protrusions 150'', the board apertures to receive them are spaced as shown by phantom apertures 152''. When the protrusions are located as shown by phantom protrusions 150''', the board apertures to receive them are spaced as shown by phantom apertures 152'''.

While the invention has thus far been described as employing two identical shrouds 22, each having a protrusion 150 such that the assembly 62 is symmetrical, a single shroud 22 and an alternate shroud 23 (not shown), substantially identical to shroud 22 but not having any protrusions 150 may be employed on opposite ends of header 20 resulting in an assembly 62' (also not shown). In this embodiment, the protrusion 150 is a polarization feature which, when provided at one of several possible locations such as protrusions 150, 150', 150'' and 150''' shown in FIG. 2, additionally provides a keying function for shroud 22 and hence assembly 62'. Furthermore, only a single protrusion receiving aperture 152 needs to be provided in circuit board 154.

To attach alignment and blind mate assist shrouds 22 to pin header 20, shrouds 22 are first positioned above top surface 98 with channels 76 and 78 aligned respectively with ribs 42 and 40 or 46 and 44, sidewalls 30 and 32 aligned between inner surfaces 70 and 72, and inner surface 74 substantially coplanar with the outer surface of a respective endwall 34, 36 as shown in FIG. 1. Shroud 22 and pin header 20 are then moved toward each other. As ribs begin to be received in channels 76, 78, ramp surface 102 engages top surface 98 of shroud 38 at an endwall. The reactionary forces resulting from continued movement of shroud 22 and pin header 20 toward each other causes latch 94 to flex outwardly until the inner edge of ramp surface 102 rides over the endwall. As latch 94 slides along endwall 34, the inner edge 104 slides along a respective endwall 34 or 36. When latch shoulder 96 passes beyond bottom surface 54 in recess 52, latch 94 resiles inwardly to latch beneath bottom surface 54 to secure shroud 22 to pin header 20, resulting in assembly 62 as shown in FIG. 3.

In the preferred embodiment with latch shoulder 96 latched under bottom surface 54, bottom surfaces 80 and 82 engage the top surface 98 of shroud 38. This structure provides means on the shroud cooperable with the header to secure the shroud to the header.

Shroud 22 is secured to pin header 20 in a predetermined location with the vertical position of shroud 22 maintained relative to pin header 20.

The ribs and channels complement each other to provide means on the shroud cooperable with the header to secure shroud 22 to pin header 20. Inner surfaces 70 and 72, sidewalls 30 and 32, ribs 40 and 42 or 44 and 46, channels 76 and 78, endwalls 34 and 36 as well as inner surface 74 cooperate to secure a respective shroud 22 on pin header 20 in a predetermined location with the horizontal position of shroud 22 maintained relative to pin header 20. With shroud 22 positioned on and secured to pin header 20 as described above, resulting in assembly 62 shown in FIG. 3, shroud 22 provides an alignment and blind mating function for a complementary receptacle connector, not shown. A typical complementary receptacle connector is part no. 746285-6 sold by the assignee.

Side members 64 and 66 as well as end member 68 extend above top surface 98 of shroud 38 and provide beveled surfaces 110, 112 and 114 respectively which taper inwardly in a direction from top surface 116 to bottom surface 80. Beveled surfaces 110, 112 and 114 collectively provide lead-in for the complementary connector prior to mating. Recess 118 in beveled surface 114 permits a core pin to be positioned during molding of shroud 22 to form latch shoulder 96. Each of beveled surfaces 110, 112 and 114 extend to respective limited height vertical surfaces 120, 122 and 124.

Vertical surface 122 defines the innermost edge of offset 88 which defines the innermost edge of lower surface 86. In the preferred embodiment, vertical surface 122 when shroud 22 is secured on pin header 20 is substantially coplanar with the inner surface of sidewall 32. In the preferred embodiment this results in offset 88 along side member 66 being substantially the same depth as sidewall 32 is thick. Similarly, vertical surface 122 defines the innermost edge of offset 84 which defines the innermost edge of lower surface 82. Vertical surface 120, when shroud 22 is secured on pin header 22, is substantially coplanar with the inner surface of sidewall 30. In the preferred embodiment this results in offset 84 along side member 66 being substantially the same depth as sidewall 30 is thick as best seen in FIG. 3. Vertical surface 124 defines the innermost edge of offsets 84 and 88 along inner surface 74. Vertical surface 124, when shroud 22 is secured on pin header 20 is substantially coplanar with the inner surface of endwall 36. Thus when a complementary connector is aligned to pass vertical surfaces 120, 122 and 124 it is properly aligned for mating with pins 28 of array 60.

Beveled surfaces 110, 112 and 114 permit a complementary connector to initially be misaligned and guide the complementary connector to a position of alignment. As a complementary connector is moved toward pin header 20 to mate therewith the complementary connector, if not properly aligned for mating, will engage one or more of the beveled surfaces 110, 112 or 114 on a shroud 22. As the complementary connector continues to move toward pin header 20 for mating, reactionary forces between the complementary connector and beveled surfaces 110, 112 or 114 will cause the complementary connector to align with the pin header prior to mating. The beveled surfaces extend into vertical surfaces 120, 122 and 124 which further assure alignment prior to mating. The vertical surfaces also maintain alignment of the complementary connector with the pin header during unmating to prevent tilting or peeling of the complementary connector arcuately away from the pin header in a manner that could damage the pins. In this manner, shrouds 22 obviate the problems of misregistration and misalignment as well as bent pins that were a result of misalignment.

Beveled edges 130 provide a cable guide between edges 130 on the shrouds on opposite ends of pin header 20. Beveled corners 132 taper the thickness of side members 64, 66 to be narrower at distal edges thereof.

Shrouds 22 provide several advantages. The shrouds are retrofittable and thus can be added after the pin header is placed in service. Placing a shroud only at the ends of a pin header, as opposed to extending the height along the entire length of the pin header, continues to permit a right angle cable exit with the cable passing substantially across the top surface of the shroud. A pin header can be useful in a blind mating environment when shrouds 22 are utilized. Furthermore, shrouds 22 can be manufactured of various colors for color coding which one of several otherwise identical pin connectors a particular complementary connector mates with.

Figure 4:
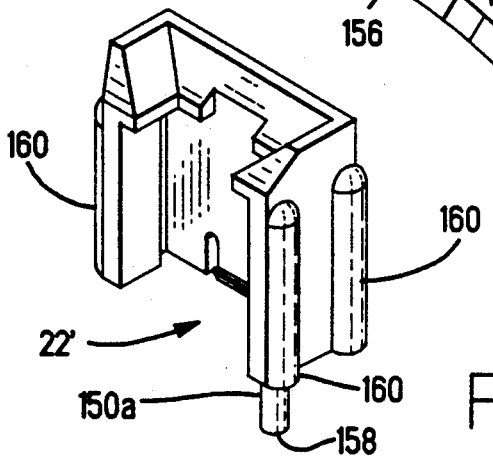
FIG. 4 is a top perspective view of an alternate embodiment alignment and blind mate assist shroud having a keying protrusion.

An alternate embodiment blind mate shroud 22' is shown in FIG. 4. Shroud 22' functions in the same manner as shroud 22, with the difference being the diameter of the protrusion 150*a*. To accommodate a protrusion having a larger diameter than the wall thickness, a thickened sidewall at least in the regions of columns 160 is provided. Shroud 22' is received over the end of the pin header and secured thereto in the same manner as shroud 22 described above.

While the preferred embodiment of the invention has been disclosed with respect to a through-hole mount connector, the invention may be used with surface mount connectors. In addition, while the preferred embodiment of the invention has been disclosed as utilizing identical shrouds on each end of connector assembly 62, such that the protrusions are symmetrical about housing 24, with a single protrusion employed on each shroud, the invention is not limited thereto. Asymmetrical protrusions and the use of more than a single protrusion on each shroud to provide a keying function are contemplated as within the scope of the invention.

We claim:

1. A polarization shroud securable to a connector housing, the housing having a plurality of contacts secured therein, the polarization shroud comprising:

a body section having means cooperable with the connector housing for securing said shroud to the connector housing and an extension section adapted to extend beyond the connector housing when the shroud is secured thereto, the extension section having guide means adapted to taper inwardly toward the connector housing for guiding a complementary connector into the connector housing; and a protrusion extending from the body section, said protrusion adapted to extend beyond a bottom surface of the connector housing when said shroud is secured thereto to be received in an aperture in a circuit board on which the shroud is mounted whereby the protrusion provides a polarization function when the polarization shroud is secured to the connector housing and the connector housing is mounted on the board.

2. A polarization shroud as recited in claim 1, wherein said protrusion is cylindrical.

3. A polarization shroud as recited in claim 1, wherein said protrusion extends from a bottom surface of said body section.

4. A polarization shroud as recited in claim 1, wherein said protrusion is provided on the shroud at one of several possible locations, whereby the location of said protrusion on the shroud provides a shroud-to-board keying function.

5. An electrical connector assembly mountable to a circuit board having a pair of spaced protrusion receiving apertures, the assembly comprising:

a housing having a plurality of contacts secured therein; and a pair of shrouds secured to said housing, each of said shrouds having a body section having means cooperable with said housing for securing a respective one of said pair of shrouds to said housing and an extension section extending beyond said housing, said extension section having guide means tapering toward said housing for guiding a complementary connector into said housing, and a protrusion extending from the body section to beyond the housing for reception in a respective one of the pair of protrusion receiving apertures in the circuit board, whereby the protrusions provide a keying function that permits mounting of the assembly on the board when the protrusions align with the pair of spaced protrusion receiving apertures and prevent mounting of the assembly on the board when the protrusions do not align with the pair of spaced protrusion receiving apertures.

6. An electrical connector assembly as recited in claim 5, wherein the protrusions are cylindrical.

7. An electrical connector assembly as recited in claim 5, wherein the protrusions extend from respective bottom surfaces of respective ones of the shrouds.

8. An electrical connector assembly as recited in claim 5, wherein the protrusions are provided on the shrouds at one of several possible locations, whereby the location of said protrusion on each shroud provides a keying function.

9. An electrical connector assembly mountable on a circuit board, the assembly comprising:

a connector housing having a plurality of contacts secured therein;

a first shroud member secured to said connector housing, said shroud member having a body section having means cooperable with the connector housing for securing said first shroud member thereto and a protrusion extending from the body section to beyond the housing for reception in a respective protrusion receiving aperture in the circuit board said first shroud member further comprises an extension section extending beyond said housing, said extension section having guide means tapering toward said connector housing for guiding a complementary connector into said housing, whereby the protrusion provides an assembly to board polarization function; and a second shroud member secured to said connector housing.

10. An electrical connector assembly as recited in claim 9, wherein the protrusion is cylindrical.

11. An electrical connector assembly as recited in claim 9, wherein the protrusion extends from a bottom surface of said first shroud member.

12. An electrical connector assembly as recited in claim 9, wherein the protrusion provided on said first shroud member is at one of several possible locations, whereby the location of said protrusion provides an assembly to board key function.

* * * * *